US010660393B2

(12) United States Patent
Ferrando Garcia et al.

(10) Patent No.: US 10,660,393 B2
(45) Date of Patent: May 26, 2020

(54) PROTECTIVE HELMET

(71) Applicants: Carlos Ferrando Garcia, Valencia (ES); David Miguel Martin, Valencia (ES); Rafael Cerda Navarro, Valencia (ES)

(72) Inventors: Carlos Ferrando Garcia, Valencia (ES); David Miguel Martin, Valencia (ES); Rafael Cerda Navarro, Valencia (ES)

( * ) Notice: Subject to any disclaimer, the term of this patent is extended or adjusted under 35 U.S.C. 154(b) by 264 days.

(21) Appl. No.: 14/424,046

(22) PCT Filed: Jun. 24, 2013

(86) PCT No.: PCT/ES2013/070414

§ 371 (c)(1),
(2) Date: Feb. 26, 2015

(87) PCT Pub. No.: WO2014/033337

PCT Pub. Date: Mar. 6, 2014

(65) Prior Publication Data

US 2015/0237947 A1 Aug. 27, 2015

(30) Foreign Application Priority Data

Aug. 30, 2012 (ES) ..... 201231350

(51) Int. Cl.
*A42B 3/32* (2006.01)

(52) U.S. Cl.
CPC ..... *A42B 3/322* (2013.01)

(58) Field of Classification Search
CPC ..... A43B 3/32; A43B 3/022; A43B 3/064; B65D 21/086; A45F 2003/205
USPC ..... 2/410, 417; 220/8
See application file for complete search history.

(56) References Cited

U.S. PATENT DOCUMENTS 2,604,630 A * 7/1952 Waring ..... A42B 1/205 2/209.11
2,893,167 A * 7/1959 Davidson ..... A01G 9/02 47/73
3,353,188 A * 11/1967 Crincic ..... A42B 3/322 2/171.1

(Continued)

FOREIGN PATENT DOCUMENTS

JP 2004-084145 3/2004
WO 00/60967 10/2000

OTHER PUBLICATIONS

International Search Report dated Nov. 27, 2013 in International (PCT) Application No. PCT/ES/2013/070414.

*Primary Examiner* — Jameson D Collier
*Assistant Examiner* — Jocelyn Bravo
(74) *Attorney, Agent, or Firm* — Wenderoth, Lind & Ponack, L.L.P.

(57) ABSTRACT

A protective helmet for protecting the head of a user, characterized in that it comprises an enveloping structure consisting of an inner component (1), at least one intermediate component (2) and an outer base component (3) having an annular configuration, where the components (1, 2, 3) are coupled one inside the other, can move in relation to each other from a retracted position to a deployed position and vice versa, and create a space, in a deployed position, corresponding to the part of the user's head that is inside the helmet.

3 Claims, 5 Drawing Sheets

(56) References Cited

U.S. PATENT DOCUMENTS

| | | | | | |
|---|---|---|---|---|---|
| 3,514,787 | A * | 6/1970 | Kennedy, Jr. | A42B 3/322 | 2/410 |
| 3,555,748 | A * | 1/1971 | Herman | E04B 1/34305 | 52/121 |
| 4,587,676 | A | 5/1986 | Estadella | | |
| 4,624,382 | A * | 11/1986 | Tontarelli | A45C 5/045 | 220/751 |
| 4,827,537 | A * | 5/1989 | Villa | A42B 3/322 | 2/410 |
| 4,929,478 | A * | 5/1990 | Conaghan | F16L 57/06 | 138/103 |
| 5,862,932 | A * | 1/1999 | Walsh | B65D 21/086 | 220/484 |
| 7,043,761 | B2 * | 5/2006 | Epling | A42C 5/04 | 2/181 |
| 7,797,764 | B2 * | 9/2010 | Norris | A42B 3/105 | 2/422 |
| 8,267,271 | B2 * | 9/2012 | Faris | B65D 11/02 | 220/703 |
| 8,479,313 | B2 * | 7/2013 | Jones | A41D 13/0005 | 2/16 |
| 2005/0127074 | A1 * | 6/2005 | Kusuma | B65D 21/086 | 220/6 |
| 2008/0276531 | A1 * | 11/2008 | Smith | A01G 9/02 | 47/86 |
| 2011/0248037 | A1 * | 10/2011 | Fung | B65D 21/0219 | 220/592.2 |

* cited by examiner

A - A

A - A

C - C

C - C

PROTECTIVE HELMET

OBJECT OF THE INVENTION

The present invention relates to a protective helmet for practicing sports activities with a certain type of risk of falling and in which a high level of protection is required, such as climbing, skating, skiing, etc., and in particular, the use of a bicycle.

It is of special application in the field of the sports industry.

TECHNICAL PROBLEM TO BE SOLVED AND BACKGROUND OF THE INVENTION

In the current state of the art a variety of methods are known related to obtaining greater levels of safety for activities, in particular sports activities, in which wearing a helmet is increasingly often required for avoiding or at least reducing the consequences of a fall or a crash.

This is of special application in the practice of sports activities with a certain type of danger for the risk of falling due to the height or speed reached, such as climbing, skating or skiing, and more particularly, in the field of cycling.

Likewise, it must be taken into account that there are rules requiring the mandatory use by cyclists of a helmet for avoiding or, at least limiting, damage in accidents.

Protective helmets have undergone great transformations since their beginnings. These changes have been mainly focused on the design and incorporation of new materials, with the aim of meeting increasingly strict safety requirements.

However, there is a negative aspect common to all helmets, which is still a real drawback, and this is their extraordinary volume, causing great discomfort to the user when the helmet is transported without wearing it. The currently existing solutions are based on systems which are complex and economically not very feasible.

Two documents may be mentioned as the closest state of the art. The first one is JP200484145, which presents a configuration of the type of the present invention, although the reduction achieved in the volume is not really significant, still maintaining the problem of the high volume. The second case is document KR200110012557A, in which the folding/retraction of the helmet is significant enough, although the retraction system by means of hinges causes it to have a high cost.

The present invention solves these problems which, as we have discussed, are not solved in the present state of the art, and manages to reduce the retracted helmet to a very manageable thickness, in a simple an efficient manner.

DESCRIPTION OF THE INVENTION

The present invention relates to a protective helmet for protecting the head of a user, with a surrounding structure consisting of an inner component, at least one intermediate component and an outer base component having an annular configuration, which are coupled one inside the other. The inner, intermediate and outer base components can move in relation to each other from a retracted position to a deployed position and vice versa creating a space, in the deployed position, corresponding to the part of the user's head that is inside the helmet.

The components of the protective helmet are telescopically coupled to each other by means of axial guide elements which comprise male and female elements.

The intermediate component comprises female axial guide elements in its inner circumference as well as in its outer circumference.

The inner component comprises male axial guide elements which are coupled to the female axial guide elements located along the inner circumference of the intermediate component.

The outer base component comprises male axial guide elements which are coupled to the female axial guide elements located in the outer circumference of the intermediate component.

The intermediate component comprises upper and lower tabs which define the retracted position of the helmet, where the upper tabs make contact against a stepped inner edge portion of the outer component, while the lower tabs make contact against angular seats established along the upper circumference of the inner component.

The components of the protective helmet are joined by means of hinged portions made of an elastic and flexible material which join the three components together by their confluence zones, where the described structure enables the helmet to be put in a retracted position in which the three components are housed one inside the other, while in the deployed position, the three components are arranged in axial extension, creating a surrounding/covering space according to the space which protects the user's head.

The intermediate component of the protective helmet has a section in the form of a spindle, wherein the end zones of this section in the form of a spindle comprise hinged portions which join the intermediate component over its entire contour to the inner component by one of its ends and to the outer component by its other end.

The inner component of the protective helmet has the form of skullcap.

BRIEF DESCRIPTION OF THE FIGURES

For a better understanding of the present invention, the figures listed below have been included in this specification.

A list of the references used in the figures is provided below:

1. Inner component.
2. Intermediate component.
3. Outer base component.
4. Female axial guide elements.
5. Male axial guide elements.

6. Intermediate component upper tabs.
7. Intermediate component lower tabs.
8. Inner edge portion of the outer component.
9. Inner component angular seats.
10. Hinged portions.
11. Through hole.

DETAILED DESCRIPTION

The description of two forms of preferred embodiments of the invention is made below, referring to the references in the figures.

The invention relates to a protective helmet which comprises three elements: an inner component (1), an intermediate component (2) and an outer base component (3). These elements are retractable by means of pressure, each one being folded inside the next one.

A description of the invention based on the previously mentioned figures is made below.

FIGS. 1 to 5 show a first embodiment of the present invention.

Figure 1:
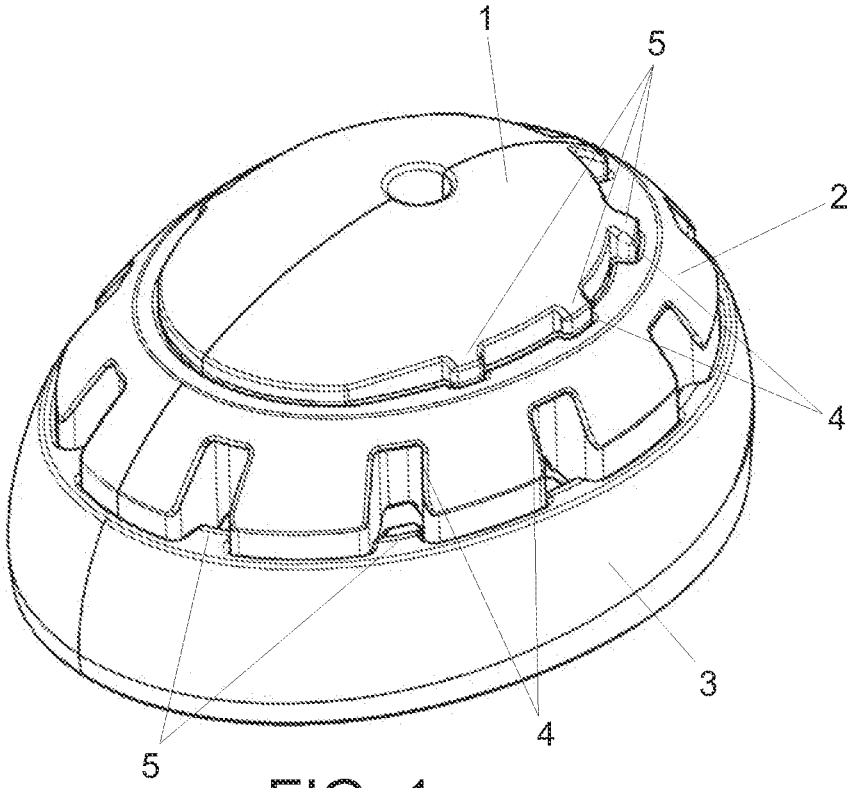
FIG. 1 depicts a perspective view of a first embodiment of the helmet in its deployed position.

FIG. 1 shows a perspective view of the helmet in its deployed position, where its three constitutive components (1, 2, 3) may be distinguished. The male (5) and female (4) guide elements are also shown. Also, as shown in FIG. 1, at least one through hole (11) is provided in the inner component.

Figure 2:
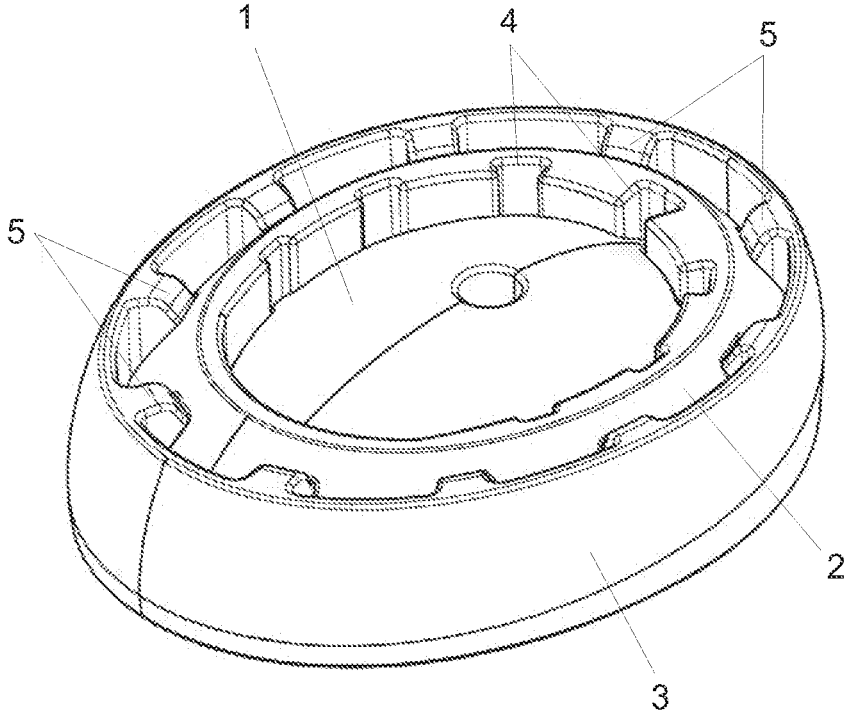
FIG. 2 depicts a perspective view of the first embodiment of the helmet in its retracted position.

FIG. 2 shows a perspective view of the helmet in its retracted position, where its three constitutive components (1, 2, 3) may be distinguished. The male (5) and female (4) guide elements are also shown.

Figure 3:
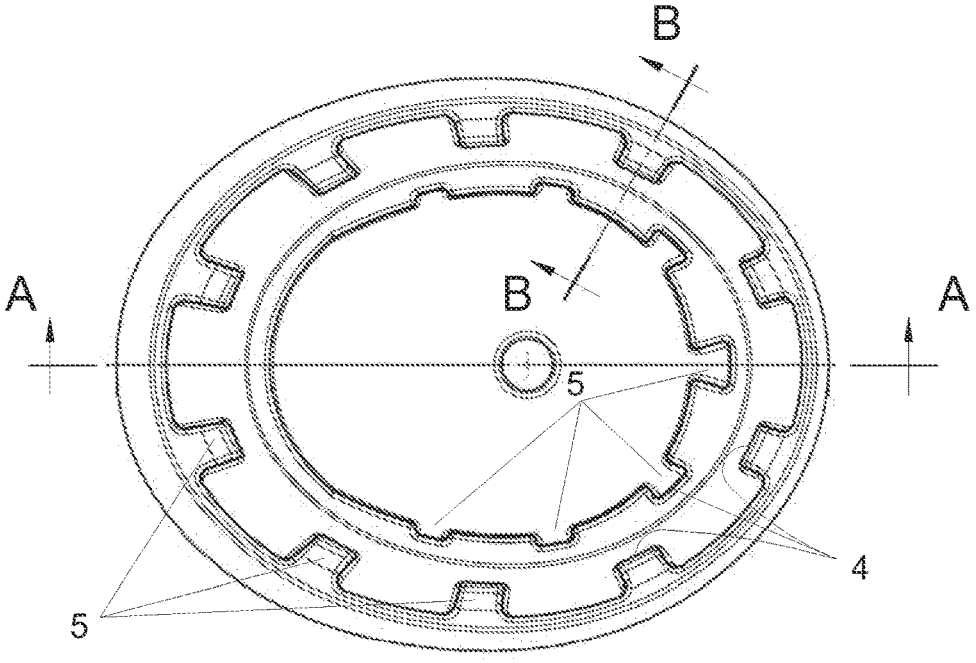
FIG. 3 depicts a plan view of the first embodiment of the helmet in its deployed position.

FIG. 3 shows a plan view of the helmet in its retracted position.

Figure 4A:
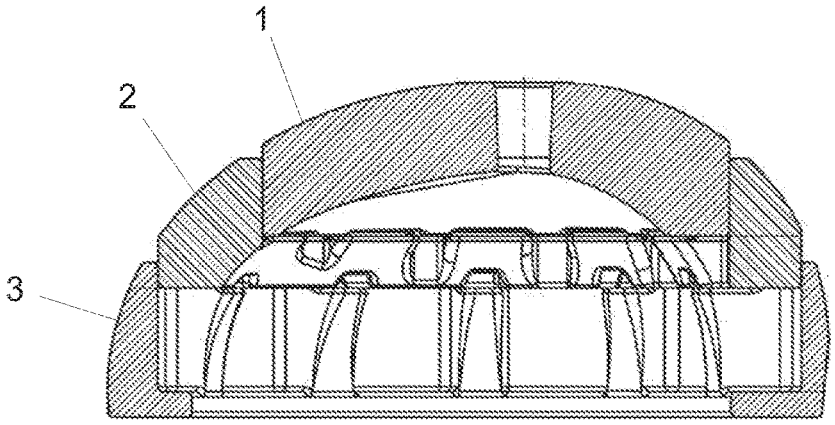
FIGS. 4*a* and 4*b* depict cross-section views of the first embodiment of the helmet along plane A-A in its deployed and retracted positions respectively.
Figure 4B:
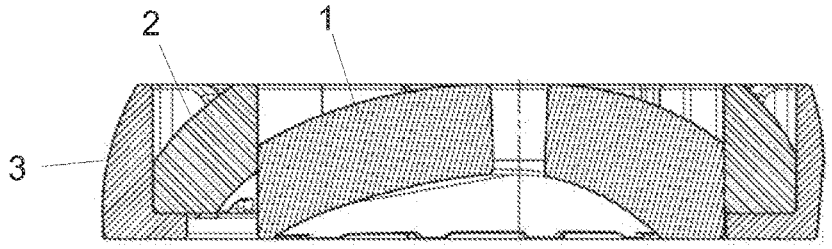

FIGS. 4*a* and 4*b* show cross-section views along to the cross-sectional plane A-A of the helmet in its deployed and retracted positions respectively.

Figure 5A:
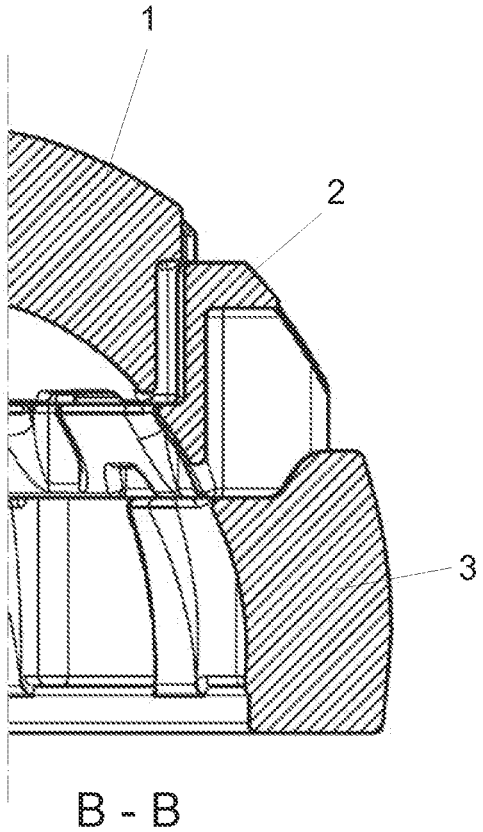
FIGS. 5*a* and 5*b* depict cross-section views of the first embodiment of the helmet along plane B-B in its deployed and retracted positions respectively.
Figure 5B:
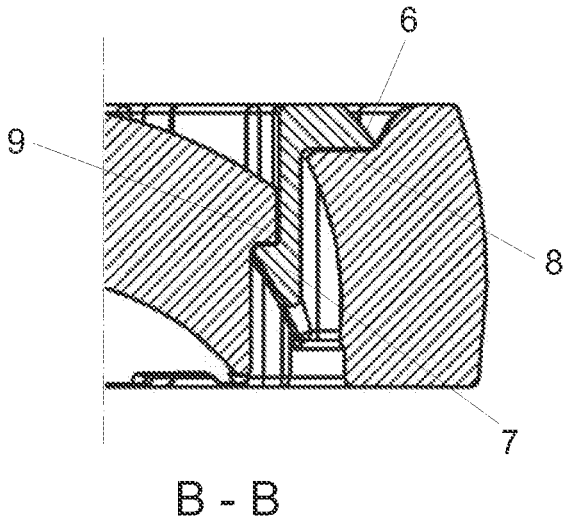

FIGS. 5*a* and 5*b* show cross-section views along to the cross-sectional plane B-B of the helmet in its deployed and retracted positions respectively in the zone of the guide elements, such that the operations of the guide system may be seen in detail.

The material used for manufacturing the helmet in this embodiment is a polymer suitable for absorbing impacts, with the possibility of incorporating an outer layer of another material with a function which is esthetic and also distributes stress in the event of an impact.

FIGS. 6 to 9 show a second embodiment of the present invention.

Figure 6:
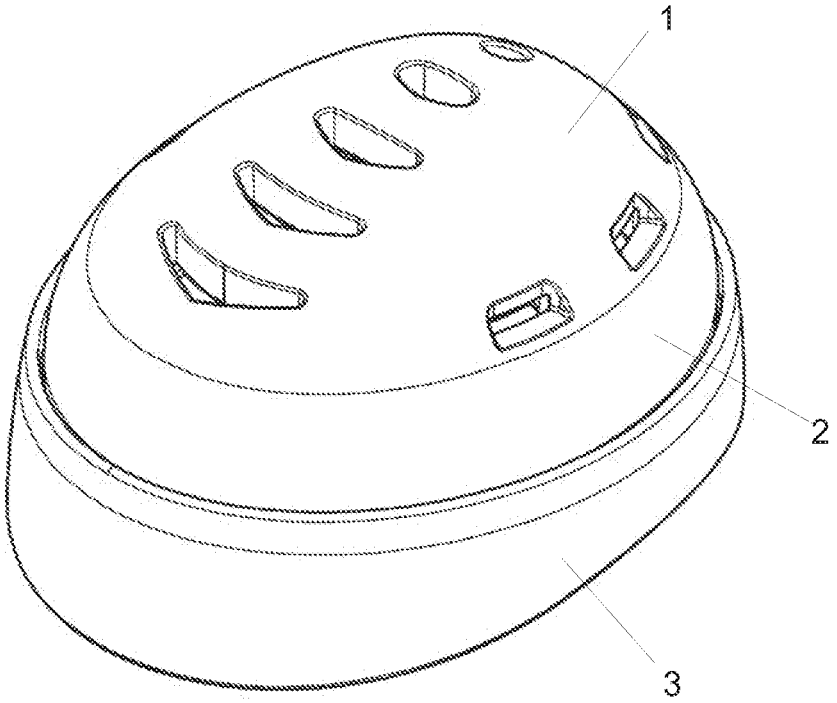
FIG. 6 depicts a perspective view of a second embodiment of the helmet in its deployed position.

FIG. 6 shows a perspective view of the helmet in its deployed position, where its three constitutive components (1, 2, 3) may be distinguished. As shown in FIG. 6, the inner component (1) has an elliptical shape and is provided with a plurality of through holes (11) formed along the major axis of the inner component.

Figure 7:
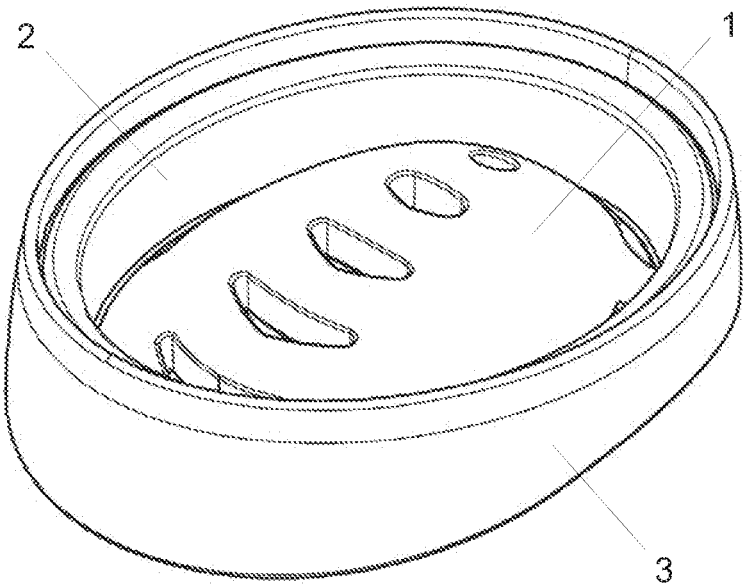
FIG. 7 depicts a perspective view of the second embodiment of the helmet in its retracted position.

FIG. 7 shows a perspective view of the helmet in its retracted position, where its three constitutive components (1, 2, 3) may be distinguished.

Figure 8:
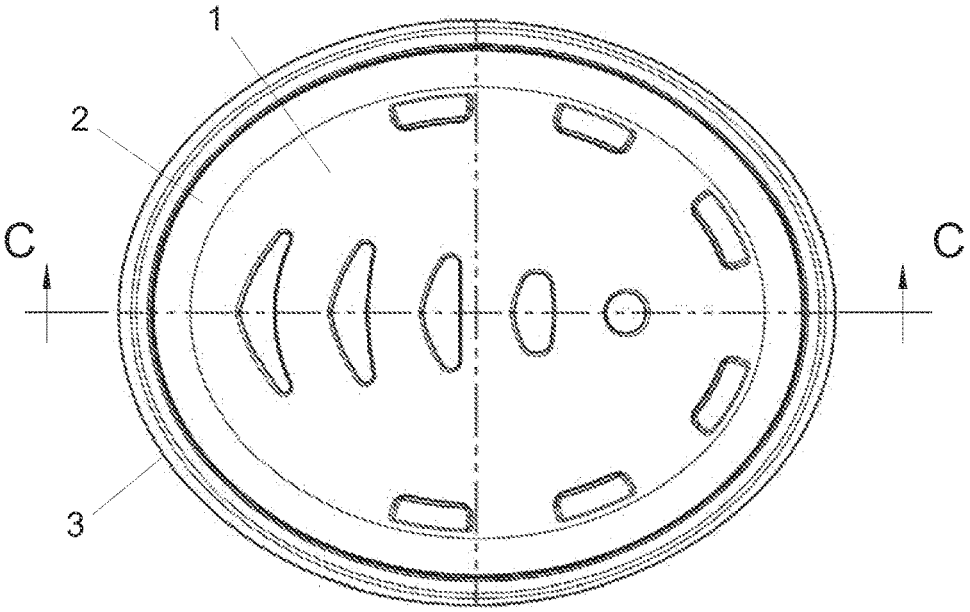
FIG. 8 depicts a plan view of the second embodiment of the helmet in its deployed position.

FIG. 8 shows a plan view of the helmet in its retracted position.

Figure 9A:
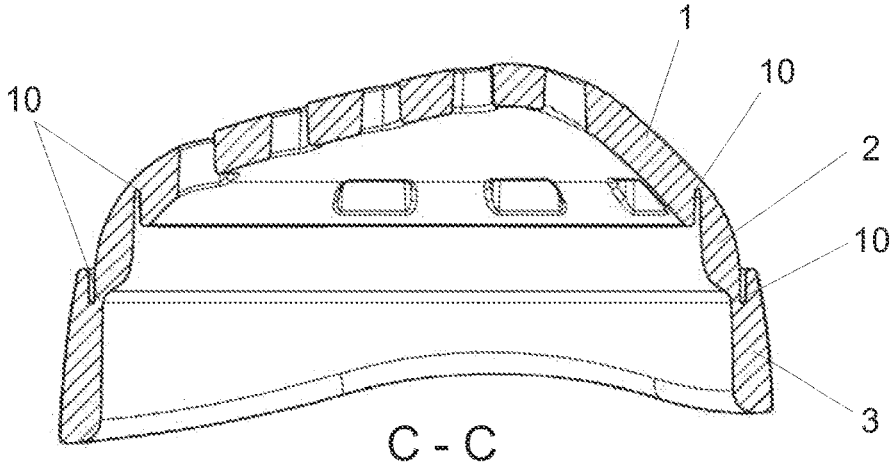
FIGS. 9*a* and 9*b* depict cross-section views of the second embodiment of the helmet along plane CC in its deployed and retracted positions respectively.
Figure 9B:
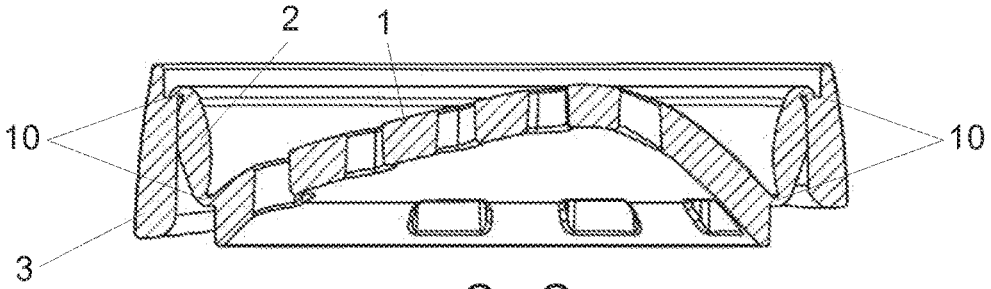

FIGS. 9*a* and 9*b* show cross-section views according to the cross-sectional plane C-C of the helmet in its deployed and retracted positions respectively, in which the hinged portions (10) may be seen, which join the inner component (1) to the intermediate component (2), as well as the intermediate component (2) to the outer base component (3).

For this embodiment, the helmet is made of an elastomeric material with very good elasticity and flexibility, to be able to retract and deploy during regular use without affecting its working life.

Those skilled in the art will understand that the examples indicated relate to different possible embodiments, although other generic embodiments are possible. In general, the helmets depicted in this invention may have any geometry and design in terms of esthetics, provided that they do not affect the described functions.

Consequently, the scope of the invention is defined by the following claims.

The invention claimed is:

1. A protective helmet for protecting a head of a user, the protective helmet comprising an enveloping structure defined by:

an inner component, at least one intermediate component having a fully closed annular configuration; and an outer base component having a fully closed annular configuration, wherein the inner component, the at least one intermediate component, and the outer base component are coupled one inside the other by axial guiding means that are aligned in a direction substantially perpendicular to a plane formed by a perimeter of the fully closed annular configuration of the at least one intermediate component, wherein the inner component, the at least one intermediate component, and the outer base component can move in relation to each other along the axial guiding means and remain in contact at all times when passing from a fully retracted position to a fully deployed position and vice versa, creating a space, in the deployed position, configured to surround the user's head, wherein the components of the protective helmet are formed of a polymer suitable for absorbing impacts, thereby protecting the user's head from such impacts, wherein the inner component includes at least one through hole, wherein the inner component, the at least one intermediate component, and the outer component are telescopically coupled to each other by the axial guiding means which comprise male and female elements, and wherein the at least one intermediate component comprises upper and lower tabs for securing the helmet in the retracted position, wherein the upper tabs abut against a stepped inner edge portion of the outer component, while the lower tabs abut against angular seats established along an upper perimeter of the inner component.

2. The protective helmet according to claim 1 wherein the inner component has the form of a skullcap.

3. A protective helmet for protecting a head of a user, the protective helmet comprising an enveloping structure defined by:

an inner component, at least one intermediate component having a fully closed annular configuration; and an outer base component having a fully closed annular configuration, wherein the inner component, the at least one intermediate component, and the outer base component are coupled one inside the other by axial guiding means that are aligned in a direction substantially perpendicular to a plane formed by a perimeter of the fully closed annular configuration of the at least one intermediate component, wherein the inner component, the at least one intermediate component, and the outer base component can move in relation to each other along the axial guiding means and remain in contact at all times when passing from a fully retracted position to a fully deployed position and vice versa, creating a space, in the deployed position, configured to surround the user's head, wherein the components of the protective helmet are formed of a polymer suitable for absorbing impacts, thereby protecting the user's head from such impacts, wherein the inner component includes at least one through hole, wherein the axial guiding means comprises:

female axial guide elements along an inner perimeter and along an outer perimeter of the at least one intermediate component, male axial guide elements on the inner component which are coupled to the female axial guide elements located along the inner perimeter of the at least one intermediate component, and male axial guide elements on the outer base component which are coupled to the female axial guide elements located in the outer perimeter of the at least one intermediate component, wherein the at least one intermediate component comprises upper and lower tabs for securing the helmet in the retracted position, and wherein the upper tabs abut against a stepped inner edge portion of the outer component, while the lower tabs abut against angular seats established along an upper perimeter of the inner component.

* * * * *